US007921962B2

(12) United States Patent
Liddell

(10) Patent No.: US 7,921,962 B2
(45) Date of Patent: Apr. 12, 2011

(54) SILENCING ARRANGEMENT

(75) Inventor: Sarah Helen Liddell, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

(21) Appl. No.: 12/710,042

(22) Filed: Feb. 22, 2010

(65) Prior Publication Data

US 2010/0219013 A1 Sep. 2, 2010

(30) Foreign Application Priority Data

Feb. 27, 2009 (GB) ..... 0903411.7

(51) Int. Cl.
*F01N 13/00* (2010.01)

(52) U.S. Cl. ..... 181/225; 181/214; 181/212; 415/119

(58) Field of Classification Search ..... 181/225, 181/212, 214, 287, 30; 415/119; 52/144, 52/145

See application file for complete search history.

(56) References Cited

U.S. PATENT DOCUMENTS 4,786,231 A * 11/1988 Kelley ..... 415/119
5,159,738 A * 11/1992 Sunagawa et al. ..... 15/326
5,326,317 A * 7/1994 Ishizu et al. ..... 454/354
6,158,082 A * 12/2000 Beckey et al. ..... 15/326
2005/0044654 A1* 3/2005 Ni ..... 15/326
2006/0153674 A1* 7/2006 Kamoshita et al. ..... 415/119
2008/0256744 A1* 10/2008 Rowntreer et al. ..... 15/350

FOREIGN PATENT DOCUMENTS

| | | |
|---|---|---|
| EP | 1 510 166 | 3/2005 |
| GB | 23994 | 5/1913 |
| JP | 2007-282766 | 11/2007 |
| WO | WO 02/052109 A1 | 7/2002 |
| WO | WO 02/052110 A1 | 7/2002 |

OTHER PUBLICATIONS

GB Search Report directed at application No. GB0903411.7 dated May 25, 2009.
International Search Report and Written Opinion mailed Jun. 18, 2010 directed to PCT/GB2010/050244; 9 pages.

* cited by examiner

*Primary Examiner* — Forrest M Phillips
(74) *Attorney, Agent, or Firm* — Morrison & Foerster LLP

(57) ABSTRACT

In an appliance, such as a cyclonic vacuum cleaner, a motor is arranged to drive an impeller fan located in a motor and fan unit. The rotation of the impeller may cause nuisance tones to be generated. A silencing arrangement is provided to control such noise and includes a plurality of discrete passive silencers in the form of tube silencers arranged in a first set and a second set. The tube silencers have open end portions arranged to face the fan and the silencers of the first set are spaced from the silencers of the second set in both axial and radial directions. This combination gives the same effect as an array of closely spaced tube silencers—however, by spacing the silencers in two directions, fluid is allowed to flow freely.

21 Claims, 5 Drawing Sheets

SILENCING ARRANGEMENT

REFERENCE TO RELATED APPLICATIONS

This application claims the priority of United Kingdom Application No. 0903411.7, filed 27 Feb. 2009, the entire contents of which are incorporated herein by reference.

FIELD OF THE INVENTION

The present invention relates to a silencing arrangement arranged to control fan tone noise of a motor and fan unit, such as is employed in a vacuum cleaner.

BACKGROUND OF THE INVENTION

In a typical vacuum cleaner, Vacuum cleaners are designed to separate dirt and dust from an airflow. In a typical vacuum cleaner, the motor and fan unit generates an airflow which draws dirt- and dust-laden air into the vacuum cleaner through a dirty air inlet. The airflow then passes through a form of separating apparatus to remove dirt and dust from the airflow. Some vacuum cleaners make use of a porous bag through which the dirty air is sucked so that the dirt and dust is retained in the bag whilst cleaned air is exhausted to the atmosphere. In other vacuum cleaners, cyclonic separators are used to separate dirt and dust from the airflow. The cleaned air is then drawn through a filter and the motor and fan unit itself. The air exiting the motor and fan unit may pass through another filter arranged to remove small carbon particles produced by the motor itself and/or allergens and other microscopic particles, before exiting the vacuum cleaner through an exhaust.

A problem which may be encountered with such appliances is that of tones generated by the rotating fan. As the blades of the fan rotate, they cause pressure fluctuations in the surrounding air and effect a tonal noise at a blade passing frequency (BPF). The BPF is proportional to the rotational speed of the fan and the number of blades of the fan. Such a fan tone can be intense and annoying for a user of the appliance.

SUMMARY OF THE INVENTION

The invention provides a silencing arrangement arranged to control fan tone noise for a motor and fan unit in which the motor is arranged, in use, to drive rotatably the fan about a rotational axis, the silencing arrangement comprising a plurality of discrete passive silencers arranged in first and second sets having open end portions arranged to face the fan, the silencers of the first set being spaced from the silencers of the second set in an axial direction and additionally being spaced from the silencers in the second set when viewed along the axial direction.

The silencers of the first set may be angularly spaced from the silencers in the second set when viewed along the axial direction.

The silencers of the first set may be spaced from the silencers in the second set in a radial direction, so that there is provided a silencing arrangement arranged to control fan tone noise of a motor and fan unit in which the motor is arranged, in use, to drive rotatably the fan about a rotational axis, the silencing arrangement comprising a plurality of passive silencers arranged in first and second sets having open end portions arranged to face the fan, the silencers of the first set being spaced from the silencers of the second set in both axial and radial directions.

The provision of first and second sets of silencers provides a greater noise cancelling effect at the tone or tones of interest than one set alone. In spacing the silencers in two directions, the overall effect is that of an array of closely interposed silencers acting on sound waves generated by different regions of the fan.

Preferably, the first and second sets are spaced such that the region between them comprises a flow path for fluid being drawn, in use, by the fan.

The silencers of one or both sets advantageously comprise discrete tubes having an open end and a closed end and arranged at peripheral regions of the fluid flow path, so that the silencers themselves interfere as little as possible with the flow of fluid.

The silencers of one or both sets are preferably arranged such that the sets have rotational symmetry about the rotational axis of the fan.

One set of silencers may be formed as an integral part of a housing for the motor and fan unit. This arrangement simplifies both manufacture and assembly, and ensures that the tube silencers of that set are in predetermined positions with respect to the fan.

One or both sets of silencers may be tuned to a frequency of interest, such as the BPF of the fan in a mode of operation. The sound cancelling effect of such an arrangement is enhanced by axially spacing the first and second sets by an integral number of half-wavelengths corresponding to the frequency of interest.

The invention may be incorporated in any appliance incorporating a motor and fan unit arranged to generate a flow of fluid through the appliance. The invention is of particular benefit in appliances generating an airflow within, such as a vacuum cleaner.

One set of silencers may be moulded as part of an inner surface of the casing of the appliance, such as a door permitting access to the interior of the appliance. In the case that the invention is employed in a surface-treating appliance, such as a vacuum cleaner, the door may form part of a wheel arranged to allow the appliance to roll along a floor surface. The door may allow access to a filter, which may be removably attached to the door itself.

BRIEF DESCRIPTION OF THE DRAWINGS

The invention will now be described, by way of example, with reference to the accompanying drawings, in which.

DETAILED DESCRIPTION OF THE INVENTION

Figure 1:
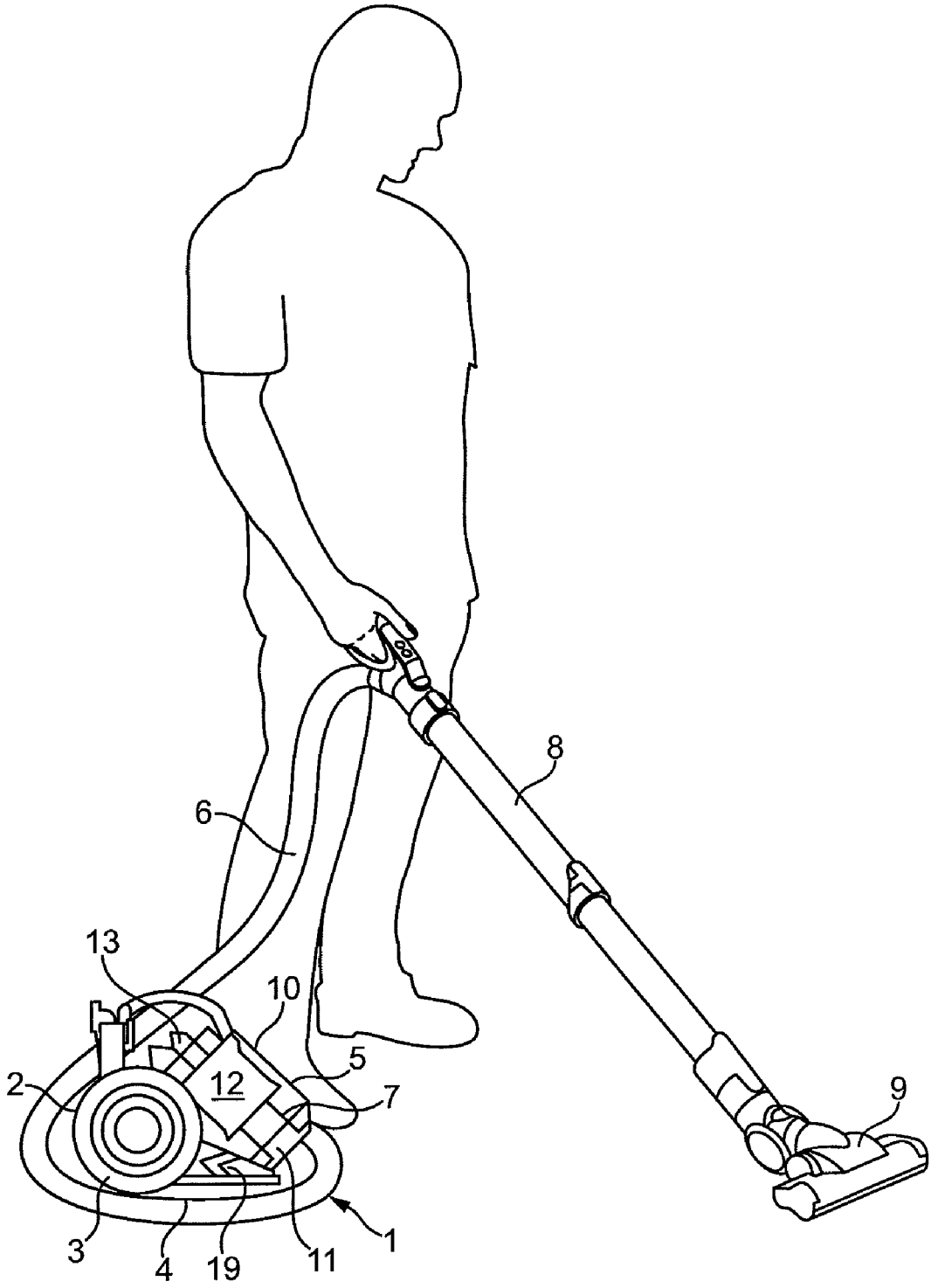
FIG. 1 is a side view of a surface treating appliance constructed in accordance with the invention in use.

Like reference numerals refer to like parts throughout the specification.

With reference to FIG. 1, a surface-treating appliance is shown in the form of a cyclonic vacuum cleaner 1. The vacuum cleaner 1 has a main body 2 housing a motor and fan unit 3. The main body 2 includes means for allowing it travel across a floor surface, which, in this embodiment, comprises a pair of wheels 4. Separating apparatus in the form of a cyclonic separator 5 is releasably attached to the main body 2. A flexible hose 6 is connectable to an inlet port 7 on the main body 2. The other end of the flexible hose 6 is connectable to a wand 8, the distal end of which is adapted to receive a floor tool 9. During use, the main body 2 of the vacuum cleaner 1 is pulled along the floor surface by the flexible hose 6 as a user moves around a room. When the user switches on the vacuum cleaner 1, the motor 3*a* (FIG. 2) is energized and drives a fan 3*b* so as to draw in dirty air through the floor tool 9. The dirty air, carrying dirt and dust from the floor surface, is drawn through the hose 6 and wand 8 and into the cyclonic separator 5 via the inlet port 7.

The cyclonic separator 5 includes an upstream cyclone 10 in a collecting chamber 11. Air entering the cyclonic separator 5 is encouraged to follow a helical path around the interior of the upstream cyclone 10. Dirt and dust becomes separated from the swirling flow of air and is retained in the collecting chamber 11. A shroud 12 is located inwardly of the cylindrical side wall of the upstream cyclone 10. The shroud 12 comprises a cylindrical wall having a plurality of through-holes. The shroud 12 provides a communication path between the upstream cyclone 10 and a downstream cyclone assembly 13.

The downstream cyclone assembly 13 comprises a plurality of downstream cyclones arranged in parallel. Each of the downstream cyclones has a diameter smaller than that of the upstream cyclone 10. Therefore, the downstream cyclone assembly 13 is able to separate smaller particles of dirt and dust from the partially-cleaned airflow than the upstream cyclone 10. Separated dirt and dust exits the downstream cyclone assembly 13 and passes into the collecting chamber 11. The cleaned air then passes from the cyclonic separator 5 into the main body 2 of the vacuum cleaner 1.

Figure 2:
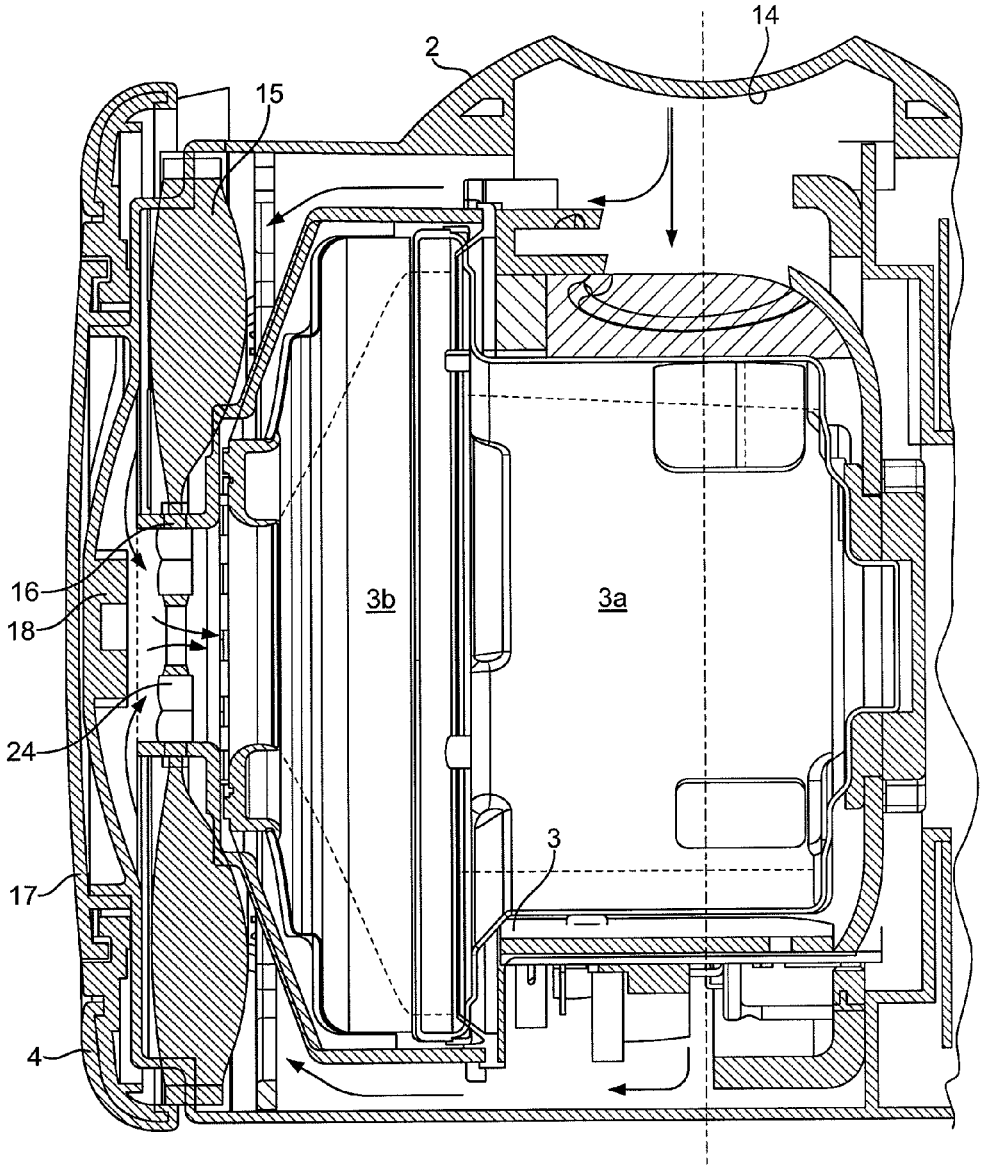
FIG. 2 is a sectional rear view of part of the main body of the appliance of FIG. 1.

FIG. 2 shows the path of air as it flows through the main body 2. Air enters via an inlet 14 in fluid communication with the cyclonic separator 5 and then is drawn through the main body 2, around the sides of the motor and fan unit 3. The air then flows through a pre-motor filter 15, so-called because it is located upstream of the motor and fan unit. The pre-motor filter 15 serves to trap any fine dust or microscopic particles which have not been separated by the two cyclonic separation stages 10, 13. The downstream side of the pre-motor filter 15 is in fluid communication with the fan and motor unit 3 via an aperture 16 formed at the centre of the pre-motor filter 15, which is annular in shape.

Part of the fluid flow path between the pre-motor filter 15 and the motor and fan unit 3 comprises an inner surface of part of the outer casing of the vacuum cleaner 1. In this embodiment, the part of the outer casing comprises a door 17, on which is rotatably mounted one of the wheels 4. A first set 18 of passive silencers is also formed as part of the inner surface of the door 17 at the periphery of the fluid flow path, and this will be described later in the specification.

The motor and fan unit 3 accommodates a fan 3*b* which is driven by the motor 3*a* to generate the suction airflow. The fan 3*b* is in the form of an impeller having a plurality of blades. The outlet of the fan and motor unit 3 communicates with a post-motor filter (not visible in these drawings). The post-motor filter serves to trap any remaining particles in the airflow, as well as carbon particles from the motor. Air then exits the post-motor filter and is exhausted from the vacuum cleaner 1 through an exhaust 19.

Figure 3:
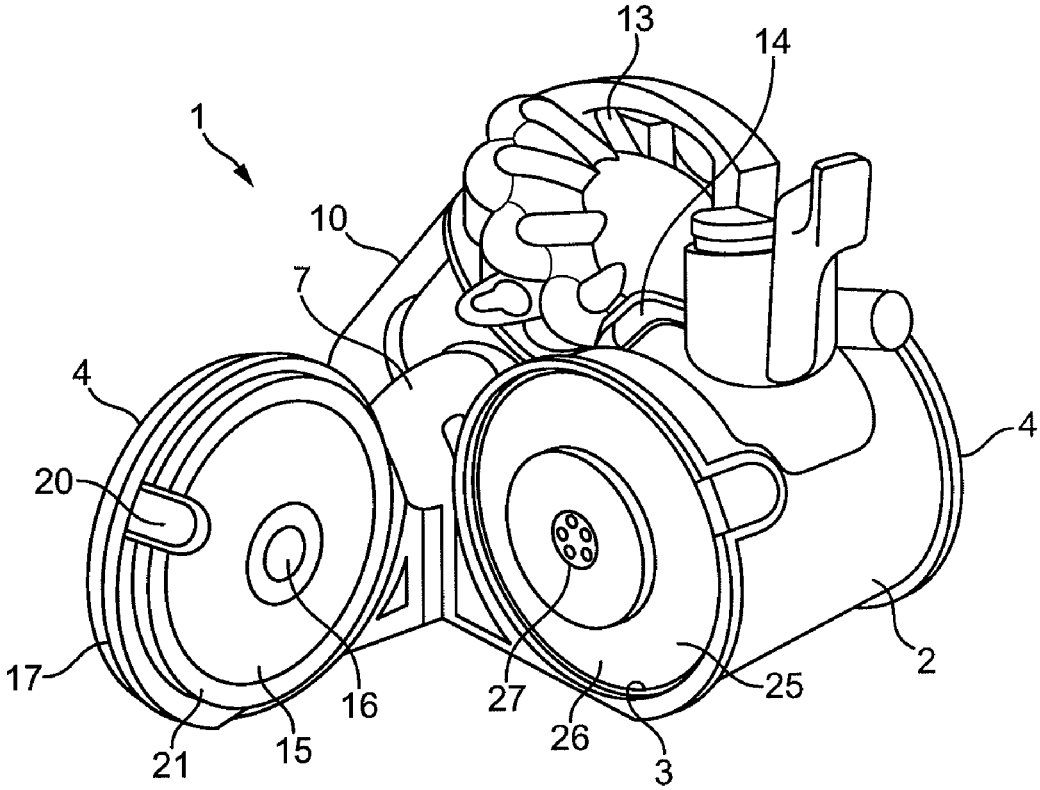
FIG. 3 is a perspective view of one side of the appliance of FIGS. 1 and 2, with its door in an open position.
Figure 4:
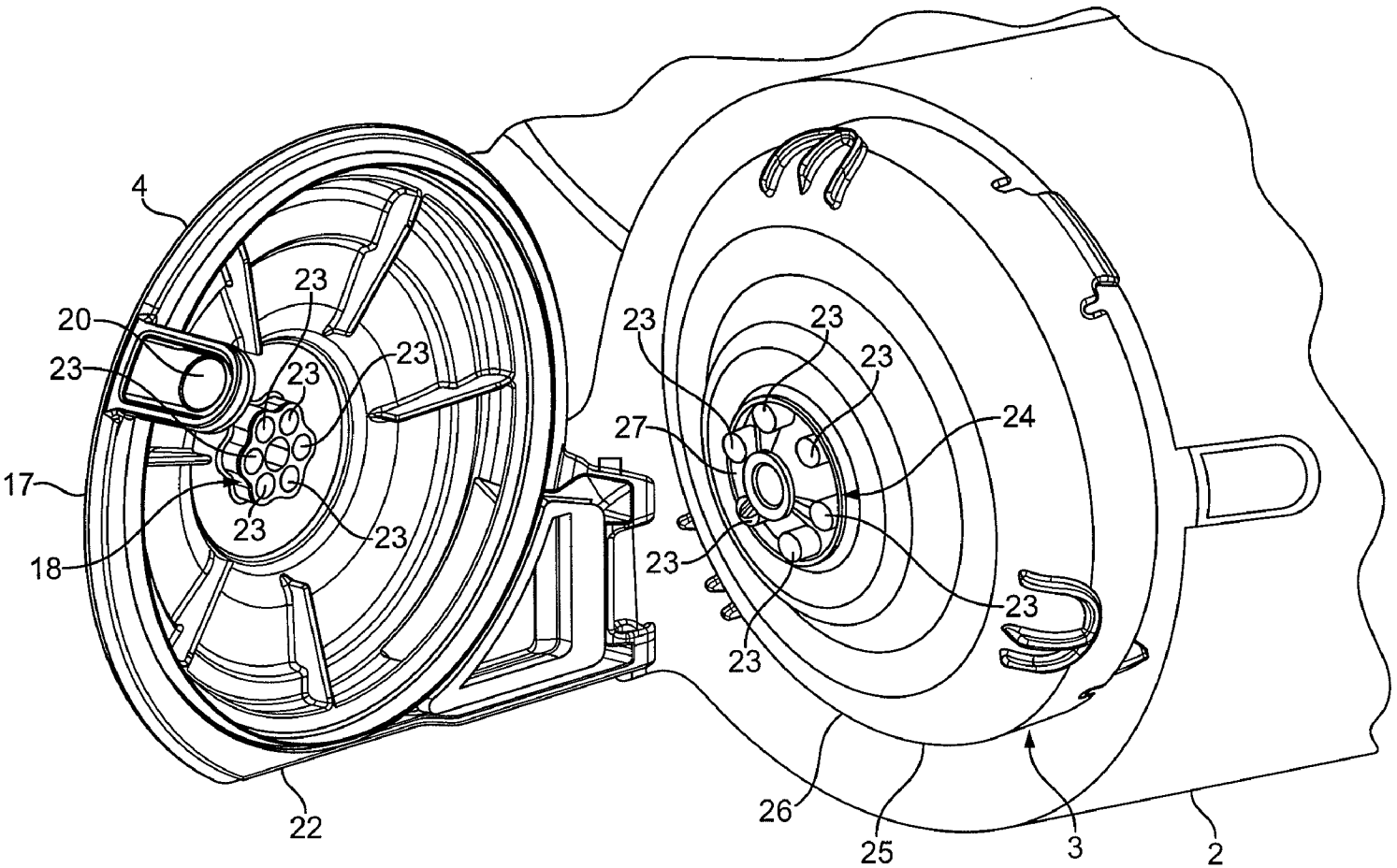
FIG. 4 is a perspective view of part of the appliance, with its door open and filter removed.

After a period of use, the pre-motor filter 15 will start to become clogged with dust and will need to be washed or replaced so as not to detrimentally affect the performance of the vacuum cleaner 1. In this embodiment, the pre-motor filter 15 is accessible by a user opening the door 17. The door 17 is held against the main body 2 by a catch 20, which is easily releasable by a user. FIG. 3 shows the door 17 in an open position. The pre-motor filter 15 is held against the periphery of the door 17: a flexible rim 21 around the circumference of the filter engages with a lip 22 on the inner surface of the door. The dirty pre-motor filter 15 can be taken off the lip 22 of the door 17 and then can be washed, dried and then returned to its position on the door, or else substituted by a new filter. The deformable, pliable nature of the rim 21 means that the filter 15 is flexible and capable of being squashed and squeezed by a user to facilitate an effective washing action. This allows the user conveniently to maintain the vacuum cleaner 1. FIG. 4 shows this part of the appliance in more detail, with the pre-motor filter 15 removed.

When the pre-motor filter 15 is removed, the first set 18 of passive silencers is fully visible. The first set 18 of passive silencers comprises a plurality of tube silencers 23. In this embodiment, six tube silencers 23 are arranged in a ring and are equally spaced around it. The first set 18 of tube silencers 23 is an integral part of the door 17, which forms part of a wheel 4 of the vacuum cleaner 1. The first set 18 of tube silencers 23 and the door 17 are moulded together as one piece. This provides ease of manufacture and also ensures that the tube silencers 23 are automatically in predetermined positions in the vacuum cleaner 1 with respect to the fan 3*b*.

Each tube silencer 23 comprises a cylinder of circular cross-section closed at one end portion and open at the other. The internal length of the tube silencer 23 is set at one quarter the wavelength of the frequency of interest—namely, a tone generated by the rotating fan 3*b*. As the tube silencer 23 is closed at one end, changes in sound pressure at the closed end are 'reflected' back down the cylinder. At the frequency of interest, the reflected sound wave will be out of phase by 180° to the original sound wave and cancellation of the two sound waves will occur. In order to get the greatest silencing effect the position of each tube silencer 23 should correspond to the position of an 'anti node' for the frequency of interest. The anti node is the point in the sound wave where the sound pressure has greatest amplitude and so occurs at half-wavelength intervals. The internal diameter of each tube silencer 23 is less than the internal length to prevent any unpredictable acoustic effects.

The first set 18 of tube silencers 23 is located in-line at the periphery of the fluid flow path formed by the inner surface of the door 17. When the door 17 is in the closed position, the open end portions of the first set 18 of silencers 23 face the impeller fan 3*b*. The distance between the impeller fan 3*b* and the first set 18 of silencers 23 corresponds to an integral number of half-wavelengths of the fan tone of interest. In order to enhance the sound-cancelling effect, a second set 24 of passive silencers is provided, which set forms part of a housing 25 for the motor 3*a* and impeller fan 3*b*.

The second set 24 of passive silencers also comprises six tube silencers 23, of the same dimensions as those of the first set 18. The open end portions of the tube silencers 23 of the second set 24 face in the same direction as those of the first set 18, namely towards the impeller fan 3*b*. The second set 24 of tube silencers 23 is closer to the fan 3*b* and is also an integral number of half-wavelengths away from it. The region between the first set 18 and second set 24 of silencers forms part of the fluid flow path. The second set 24 of tube silencers 23 is formed as an integral part of the end wall 26 of the housing 25 for the motor and fan unit 3. Thus, the second set 24 of tube silencers 23 and the end wall 26 are moulded as one piece, which simplifies both manufacture and assembly, and ensures that the tube silencers 23 of the second set 24 are in predetermined positions in the vacuum cleaner 1 with respect to the fan 3*b*. The tube silencers 23 of the second set 24 are arranged on a circle of larger diameter than the first set 18 of silencers. The tube silencers 23 of the second set 24 are spaced equidistantly around the circle. Each tube silencer 23 sits on the edge of an aperture 27 formed in the end wall 26 of the housing 25. The aperture 27 permits air to flow into the motor and fan unit 3.

Figure 5:
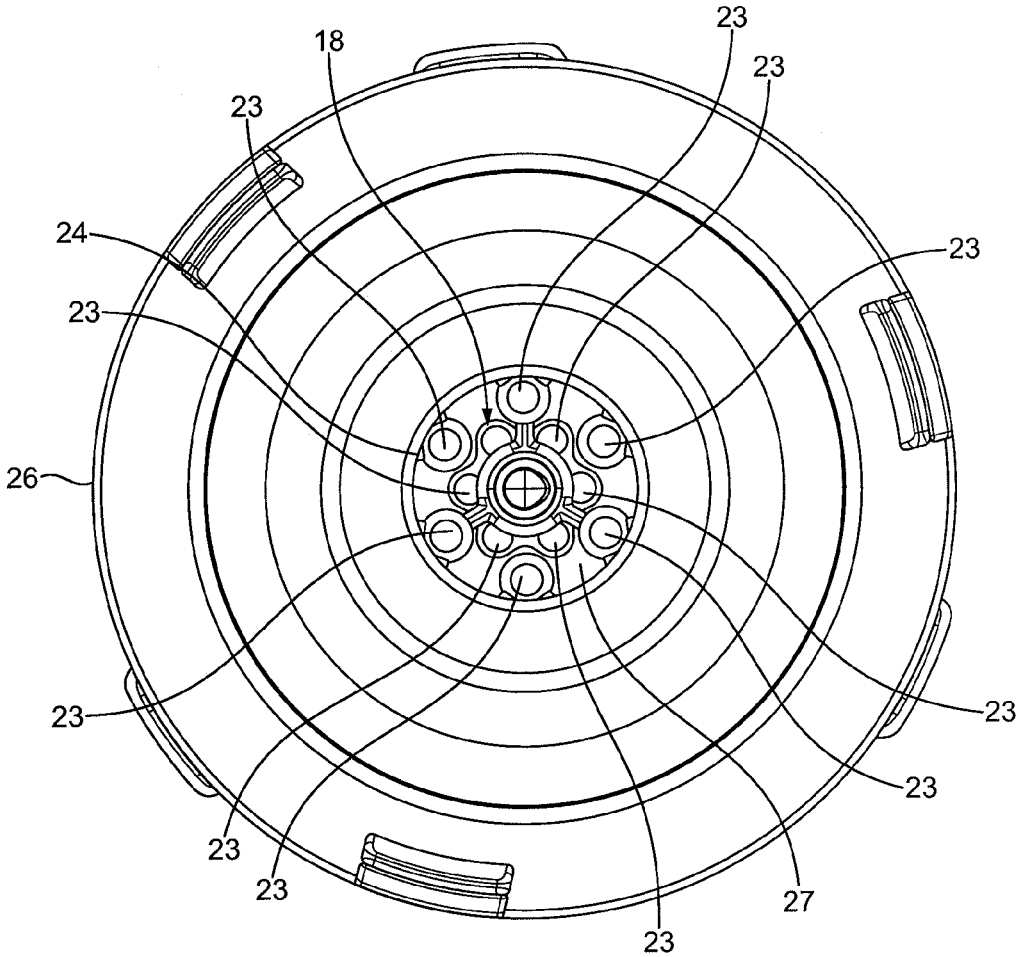
FIG. 5 is a view from inside the motor and fan unit of the appliance, facing away from the fan.

FIG. 5 is a view from inside the motor and fan unit 3, facing towards the aperture 27. The first set 18 and second set 24 of tube silencers 23 lie in parallel planes that are substantially orthogonal to the axis of rotation 28 of the fan 3*b*. The longitudinal axis of each tube silencer 23 is substantially parallel to the axis 28 of the fan 3*b*, so that the silencing arrangement faces the blades of the impeller. The first set 18 and second set 24 of silencers are arranged so that the tube silencers 23 of the first set are spaced from the tube silencers of the second set along the axis of rotation 28 and are also spaced from the tube silencers in the second set when viewed along the axial direction. Thus, the effect of the silencing arrangement is that of an array of interposed tube silencers 23 occupying almost the entire area of the aperture 27. In this case, the silencers in the first set 18 are spaced radially from the silencers in the second set 24 with respect to the axis of rotation, and are also angularly spaced from the silencers in the second set 24. Each tube silencer 23 acts on noise being generated by different portions of the impeller blades. Thus, the sound cancelling effect of the silencing arrangement is that achieved by both first and second sets 18, 24 of silencers combined. Usually, it would not be possible to have so many tube silencers 23 facing the fan 3*b*, as they would obstruct the flow of air being drawn by the fan, which would have a detrimental effect on the performance of the appliance. However, by spacing the first and second sets 18, 24 such that fluid can flow between them, and by locating the individual tube silencers 23 at the periphery of the fluid flow path, the flow of fluid is not inhibited.

In this embodiment, the tube silencers 23 of the first and second sets 18, 24 are substantially identical in internal dimension. This is because, during normal operation, the fan 3*b* is arranged to rotate at a predetermined rotational speed, and so there will usually be only one fan tone of interest. However, in an appliance having several modes of use, the fan may be arranged to rotate at one of several speeds, and so there will be more than one tone of interest. For such an appliance, the tube silencers of the first set may be arranged to have different dimensions from those of the second set so that sound waves of two different frequencies may be cancelled.

In general, the silencers in the first set and second set may be spaced from one another in any suitable manner. The silencers in the two sets do not need to have a common spacing; different angular spacings and/or radial spacings may be utilised within the same arrangement.

The respective silencers that make up each set need not be identical. They may have a variety of internal dimensions in order to reduce the effect of a spectrum of frequencies. Further sets of silencers may be provided. The silencers need not be arranged in-line with the fan, but could be located transverse to a flow duct. An arrangement in which the open ends of the silencers face the fan is most effective.

Other types of silencer may be employed, such as expansion chambers, Helmholtz resonators or Hershel-Quincke resonators, for example. Alternatively, a porous material may be employed, such as a foam having pores arranged to cancel the frequency or frequencies of interest. Any combination of passive silencers may be employed.

The invention need not be applied only to a vacuum cleaner. The silencing arrangement may be employed in any appliance incorporating a motor-driven fan arranged to produce a flow of fluid, such as polishing/waxing machines, pressure washing machines, ground marking machines, shampooing machines, hand dryers, hairdryers and hairstyling apparatus, air conditioners, cooling fans and fan heaters.

The invention claimed is:

1. A silencing arrangement for controlling fan tone noise in a motor and fan unit in which the motor is arranged, in use, to drive rotatably the fan about a rotational axis, the silencing arrangement comprising a plurality of discrete passive silencers arranged in first and second sets having open end portions arranged to face the fan and closed end portions arranged opposite the open end portions, the silencers of the first set being spaced from the silencers of the second set in an axial direction and additionally being spaced from the silencers in the second set when viewed along the axial direction.

2. A silencing arrangement according to claim 1, wherein the silencers of the first set are angularly spaced from the silencers in the second set when viewed along the axial direction.

3. A silencing arrangement according to claim 1, wherein the silencers in the first set are spaced from the silencers in the second set in a radial direction.

4. A silencing arrangement according to claim 1, in which the region between the first and second sets comprises a flow path for fluid being drawn, in use, by the fan.

5. A silencing arrangement as claimed in claim 4, in which the silencers of the first set are arranged at a first peripheral region of the fluid flow path.

6. A silencing arrangement as claimed in claim 4 or claim 5, in which the silencers of the second set are arranged at a second peripheral region of the fluid flow path.

7. A silencing arrangement according to claim 1, in which the arrangement of passive silencers of the first set has a rotational symmetry about the rotational axis of the fan.

8. A silencing arrangement according to claim 1 or 5, in which the arrangement of passive silencers of the second set has a rotational symmetry about the rotational axis of the fan.

9. A silencing arrangement according to claim 1, in which one of the first and second sets of silencers comprise part of a housing for the motor and fan unit.

10. A silencing arrangement according to claim 1, in which the silencers of the first set are tuned to a first predetermined frequency.

11. A silencing arrangement as claimed in claim 10, in which the silencers of the second set are also tuned to the first predetermined frequency.

12. A silencing arrangement as claimed in claim 11, in which the first and second sets are spaced axially by a distance of an integral number of half-wavelengths corresponding to the first predetermined frequency.

13. A silencing arrangement as claimed in claim 10, in which the silencers of the second set are tuned to a second predetermined frequency.

14. A silencing arrangement according to claim 1, in which at least one of the first and second sets is upstream of the fan.

15. An appliance incorporating a motor and fan unit and a silencing arrangement as claimed in claim 1.

16. An appliance as claimed in claim 15, having an outer casing and in which one of the first and second sets of silencers is formed on an inner surface of part of the casing.

17. An appliance as claimed in claim 16, in which the part of the casing comprises a door arranged to be openable by a user.

18. An appliance as claimed in claim 15, 16 or 17 in the form of one of the following: a hand dryer; a hairdryer; hairstyling apparatus; an air conditioner; a cooling fan; a surface treating appliance; or a fan heater.

19. An appliance as claimed in claim 17, in which the door comprises part of a wheel arranged to allow the appliance to move along a floor surface.

20. An appliance as claimed in any of claim 17, further comprising a filter which is accessible by opening the door.

21. An appliance as claimed in claim 20, in which the filter is removably attached to the door.

* * * * *